US009044080B2

(12) United States Patent
Ashenafi

(10) Patent No.: US 9,044,080 B2
(45) Date of Patent: Jun. 2, 2015

(54) SHOULDER STRAP CARRYING DEVICE

(76) Inventor: Yohannes Ashenafi, Los Angeles, CA (US)

( * ) Notice: Subject to any disclaimer, the term of this patent is extended or adjusted under 35 U.S.C. 154(b) by 279 days.

(21) Appl. No.: 13/160,182

(22) Filed: Jun. 14, 2011

(65) Prior Publication Data

US 2011/0309123 A1 Dec. 22, 2011

Related U.S. Application Data

(60) Provisional application No. 61/356,866, filed on Jun. 21, 2010.

(51) Int. Cl.
*A45F 3/04* (2006.01)
*A45F 3/14* (2006.01)

(52) U.S. Cl.
CPC ..... *A45F 3/14* (2013.01); *A45F 2003/144* (2013.01); *A45F 2200/0525* (2013.01)

(58) Field of Classification Search
CPC ..... A45F 3/04; A45F 3/042; A45F 3/047; A45F 3/06; A45F 3/08; A45F 2003/146
USPC ..... 224/259, 627, 260
See application file for complete search history.

(56) References Cited

U.S. PATENT DOCUMENTS

| | | | | | |
|---|---|---|---|---|---|
| 1,178,628 | A * | 4/1916 | Clawson | 224/259 |
| 5,361,953 | A * | 11/1994 | Nichols | 224/198 |
| 5,775,558 | A * | 7/1998 | Montalbano | 224/627 |
| 6,016,944 | A * | 1/2000 | Girbert | 224/646 |
| 6,543,661 | B1 * | 4/2003 | Lazur | 224/604 |
| 6,870,089 | B1 * | 3/2005 | Gray | 136/251 |
| 2002/0148866 | A1 * | 10/2002 | Dent, III | 224/259 |
| 2004/0195283 | A1 * | 10/2004 | Zebraski | 224/259 |
| 2004/0200870 | A1 * | 10/2004 | Haber | 224/259 |
| 2005/0263551 | A1 * | 12/2005 | Dent, III | 224/259 |
| 2007/0175940 | A1 * | 8/2007 | Sacks | 224/579 |
| 2007/0278264 | A1 * | 12/2007 | Chesal et al. | 224/160 |
| 2008/0061099 | A1 * | 3/2008 | Tilby | 224/666 |
| 2009/0090754 | A1 * | 4/2009 | Haberlein | 224/262 |
| 2009/0095784 | A1 * | 4/2009 | Enriquez | 224/650 |

* cited by examiner

*Primary Examiner* — Brian D Nash
*Assistant Examiner* — Derek Battisti
(74) *Attorney, Agent, or Firm* — Hankin Patent Law, APC; Marc E. Hankin; Kevin Schraven

(57) ABSTRACT

The invention is a shoulder strap carrying device, system, and method. The carrying device has swappable containers that connect to the straps via fasteners under the arms of the wearer. The containers enable the user to organize and easily access the personal items being carried. More particularly, the invention is a "Figure 8" shoulder strap that loops around a wearer's arms and has fasteners substantially beneath a wearer's underarms to hold multiple swappable containers, cases, and utility devices for storing various personal items.

19 Claims, 12 Drawing Sheets

SHOULDER STRAP CARRYING DEVICE

CROSS-REFERENCE TO RELATED APPLICATION

Priority is claimed to U.S. Provisional patent application Ser. No. 61/356,866, filed on Jun. 21, 2010, titled "CARRY-ALL MANBAG", by inventor Yohannes Ashenafi, the contents of which are expressly incorporated herein by this reference.

FIELD OF THE INVENTION

The invention relates to a device, method, and system for carrying personal items. More particularly, the invention is a "Figure 8" shoulder strap that loops around a wearer's arms and has fasteners beneath a wearer's underarms to hold multiple detachable and swappable containers, cases, and utility devices for storing various personal items.

BACKGROUND OF THE INVENTION

People have utilized storage devices for transporting various forms of personal items for thousands of years. Examples of such personal carrying devices include backpacks, briefcases, bags, luggage, satchels, infant carriers, purses, and fanny packs. Many of these carrying devices employ straps or other connection devices that are designed to allow the carrying device to be worn by the user. In particular, infant carriers and backpacks frequently have straps that wrap around the wearer's body and hold the carrying container close to the wearer's body.

Although these storage devices may hold numerous types of items, most do not provide the wearer with the necessary features that allow for storing personal property in an organized manner and wherein the user can easily access the stored personal property and/or easily (quickly) swap on and off the detachable and swappable containers. With backpacks, the entire pack, including the backpack straps, often must be removed from the back of the wearer in order to access the contents. Additionally, no matter how expensive the leather that the backpack is made out of, a person wearing a stylish wool suit would not also wear a backpack. Regarding brief cases, they are gentrified, and do not allow a user convenient one-handed access to the contents. Regarding the fanny pack, which is a small pouch worn around the waist of the wearer, the storage capacity is severely limited and, most importantly, fanny packs are considered to be unfashionable and gauche, even by those who care nothing for fashion.

Traditionally, most of the bags and carrying devices are specifically designed and marketed for women, such as purses. But, there has been a recent trend of increasing sales for bags designed specifically for men. This trend has coincided with the rise in the amount of electronic devices that people carry and with an increased concern by men for personal grooming habits.

Unfortunately, the bags being marketed to men do not provide easy to use, organized, and swappable content containers that are also attached to the wearer in a masculine way. Satchels, mailbags, and man bags (or man purses) are currently the trendy choice for men to carry their personal items. However, these bags are carried the same way a woman's purse is, with a single shoulder strap. In addition to being feminine, these bags, when loaded with laptop computers and other heavy personal items that a man might carry, can cause severe back strain, because the load is carried unevenly.

Regarding strap systems that fit across the shoulders of the wearer, gun and ammunition holsters have straps that fit around the wearer and hold one or more guns concealed under the arms of the wearer. Importantly, the gun straps are completed by connecting at two points to the holsters of the gun. As such, the straps are not wearable by the user without connecting a holster to the straps. Finally, these straps have only ever been used for carrying concealed weapons and have not been used for carrying other personal items.

Thus, what is needed is a masculine carrying pack that is carried using shoulder straps that distribute the weight of the contents to prevent back strain, and that provides convenient, organized, and swappable containers to hold such personal items as cell phones, wallets, keys, business cards, pens, condoms, tablet computers, media players, magazines, books, sunglasses, sundries, and personal grooming items.

SUMMARY OF THE INVENTION

To minimize the limitations in the prior art, and to minimize other limitations that will become apparent upon reading and understanding the present specification, the present invention discloses a new and useful shoulder strap carrying device, method, and system.

One embodiment of the invention is a shoulder strap carrying device comprised of a strap and one or more containers. The strap is comprised of two shoulder loop portions, a back connection portion, and one or more fastener portions. The two shoulder loop portions fit around the two upper arms and the two upper shoulders of the wearer. The two shoulder loop portions are also connected to each other by the back connection portion located at the back of the wearer. The one or more fastener portions connect to the two shoulder loop portions, such that the one or more fastener portions are substantially beneath one or more underarms of the wearer. The one or more containers are removeably connected to the one or more fastener portions, such that the one or more containers hang substantially beneath the one or more underarms of the wearer when the one or more containers are connected to the one or more fastener portions. Preferably, each of the two shoulder loop portions is further comprised of an adjustment device. Each adjustment device allows the wearer to adjust the size of each of the two shoulder loop portions. The one or more fastener portions may be slidably connected to each of the shoulder loop portions and are typically quick release snap fasteners. The one or more containers typically include one or more pouches. The shoulder strap carrying device may be further comprised of one or more universal clips. The one or more universal clips are comprised of a container connection portion and a clip portion with the connection portion attached to at least one of the one or more containers. The connection portion of the universal clip may also be removable from the one or more containers. The clip portion is preferably secured to an article of clothing of the wearer such that the one or more containers attached to the connection portion are substantially prevented from swinging. The shoulder strap carrying device may also be comprised of a front strap portion. The front strap portion is comprised of two front straps and a front fastener. Each of the two front straps is preferably connected to each of the two shoulder loop portions, and at least one of the one or more containers may be removeably connected to the front fastener. The two front straps may also be removable from the shoulder loop portions. Typically, the shoulder strap carrying device is further comprised of one or more front shoulder attachment portions, which may be connected to the front of each of the two shoulder loop portions. The one or more front shoulder attachment portions may be comprised of a sleeve to releasably hold a listening device such as one or more ear buds and one or more speakers. The one or more front shoulder attachment portions may also include a front shoulder fastener, a strap hook, and loop connection patch. The one or more pouches preferably have removable closures and are typically connected to the one or more containers. The one or more pouches may also be removable from the one or more containers.

Another embodiment of the present invention may include one or more containers further comprised of a solar panel, which may be used to generate and supply electricity to any of the wearer's external apparatuses.

The present invention may also include a hooking device, which includes one or more fasteners and a hook. The hooking device is used to suspend one or more containers when the shoulder strap carrying device is not in use.

It is an object of the present invention to overcome the limitations of the prior art. It is an object of the present invention to provide the wearer with the necessary features for storing personal property in an organized manner and for easy access of the stored personal property It is an object of the present invention to provide easy to use, organized, and swappable content containers that are attached to the wearer in a masculine way.

It is an object of the present invention to provide a masculine carrying pack that equally distributes the load carried to prevent back strain. Specifically, the present invention is worn through shoulder straps that distribute the weight of the containers to prevent back strain. The containers are located under the arms of a wearer to provide a convenient and organized access to such personal items such as cell phones, wallets, keys, business cards, pens, condoms, tablet computers, media players, magazines, books, sunglasses, sundries, and personal grooming items.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

Figure 1:
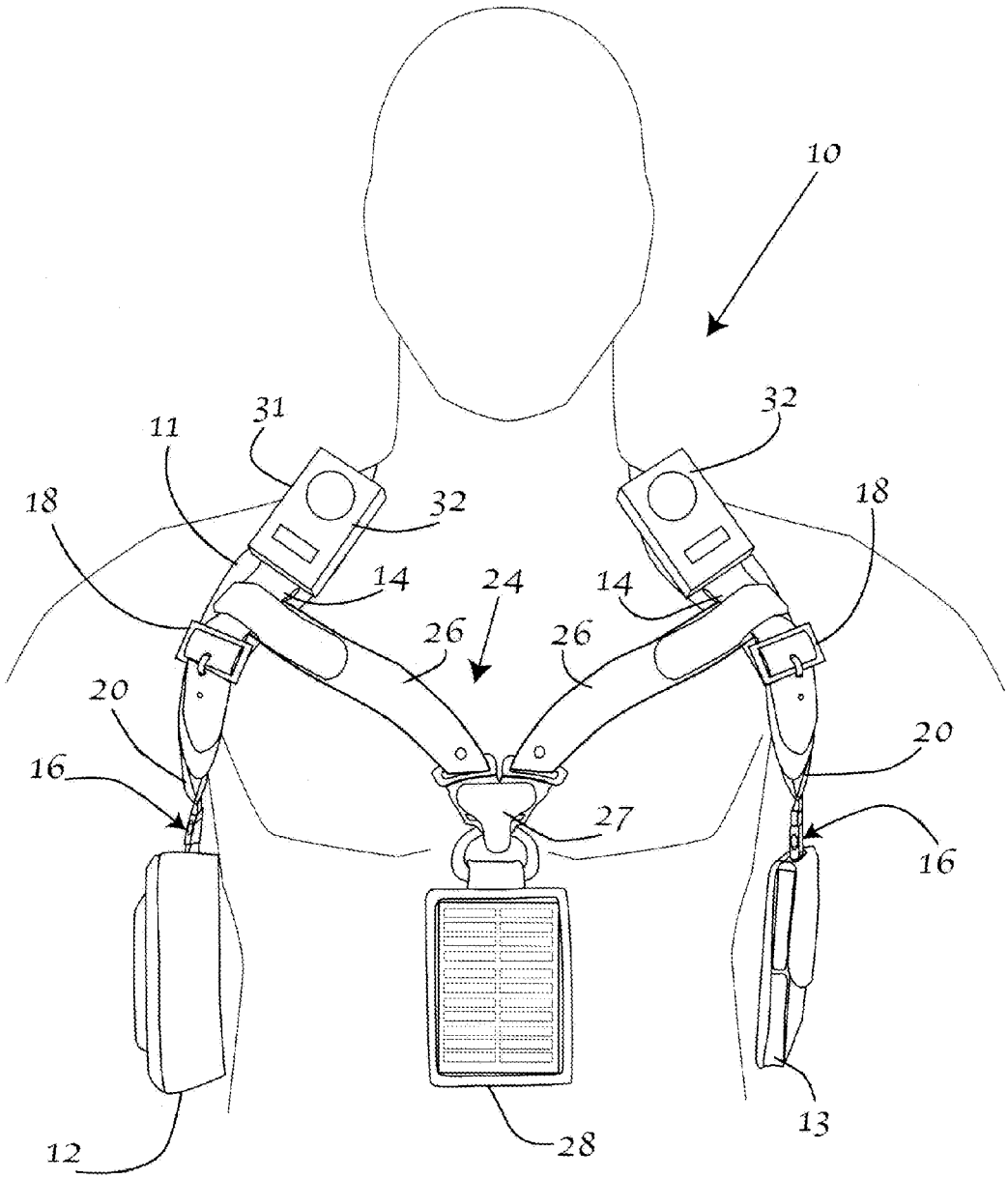
FIG. 1 is an illustration of a front view of one embodiment of the shoulder strap carrying device showing the front strap portion and solar panel.

FIG. 1 is an illustration of a front view of one embodiment of the shoulder strap carrying device with a front strap portion and solar panel. As shown in FIG. 1, the shoulder strap carrying device 10 preferably includes a strap 11, containers 12 and 13, adjustment devices 18, a front strap portion 24, solar panel 28, front shoulder attachment sleeves 31, and listening devices 32. The strap 11, preferably includes shoulder loop portions 14, a back connection portion 15 (the back connection portion 15 is shown on FIG. 3), and fastener portions 16.

FIG. 1 shows how the front strap portion 24 preferably includes front straps 26 and a front fastener 27. Although FIG. 1 shows that the carrying device 10 includes the front strap portion 24, solar panel 28, and listening device 32, it should be understood that the invention may not include these parts, or any other parts, without deviating from the scope of the invention.

FIG. 1 shows that adjustment device 18 is preferably located near the upper shoulders of the wearer, but the adjustment device may be located anywhere along the loop 14, without deviating from the scope of the invention. FIG. 1 also shows that containers 12 and 13 are preferably located substantially beneath the underarms of the wearer. This location allows easy and quick access to the contents of the containers 12 and 13. Although FIG. 1 shows only two containers 12 and 13, any number of containers may be used, including only one, without deviating from the scope of the invention. For each container that a user wants to carry, there is preferably a reciprocal fastener on the strap 11.

FIG. 1 also shows that the listening devices 32 may be speakers, but the listening devices may be any type of audio device such as an MP3 player or ear buds.

FIG. 1 also shows the front strap portion 24 of the shoulder strap carrying device 10, which is positioned across the wearer's chest. FIG. 1 shows that one end of each front strap 26 may attach to the front of the shoulder loop portions 14. The front strap 26 and may be removable or permanently attached to shoulder loop portions 14. The other end of the two front straps 26 preferably connect to the front fastener 27. Although FIG. 1 shows a solar panel 28 attached to the front fastener 27, any type of container may be attached to the front fastener 27 by any of a number of means, or none at all.

The strap and containers are preferably constructed out of high quality leather, but any natural or manmade material may be used without deviating from the scope of the invention. The fastener devices 16 and 27 are preferably quick release snap fasteners, as shown in FIG. 1, but any fastener or connection device may be used. Fastener device 16 is preferably connected to shoulder loop portion 14 by holding member 20, which may be slidable. The adjustment devices 18 are preferably metal buckles, but any type of adjustment or fastening device may be used.

Figure 2:
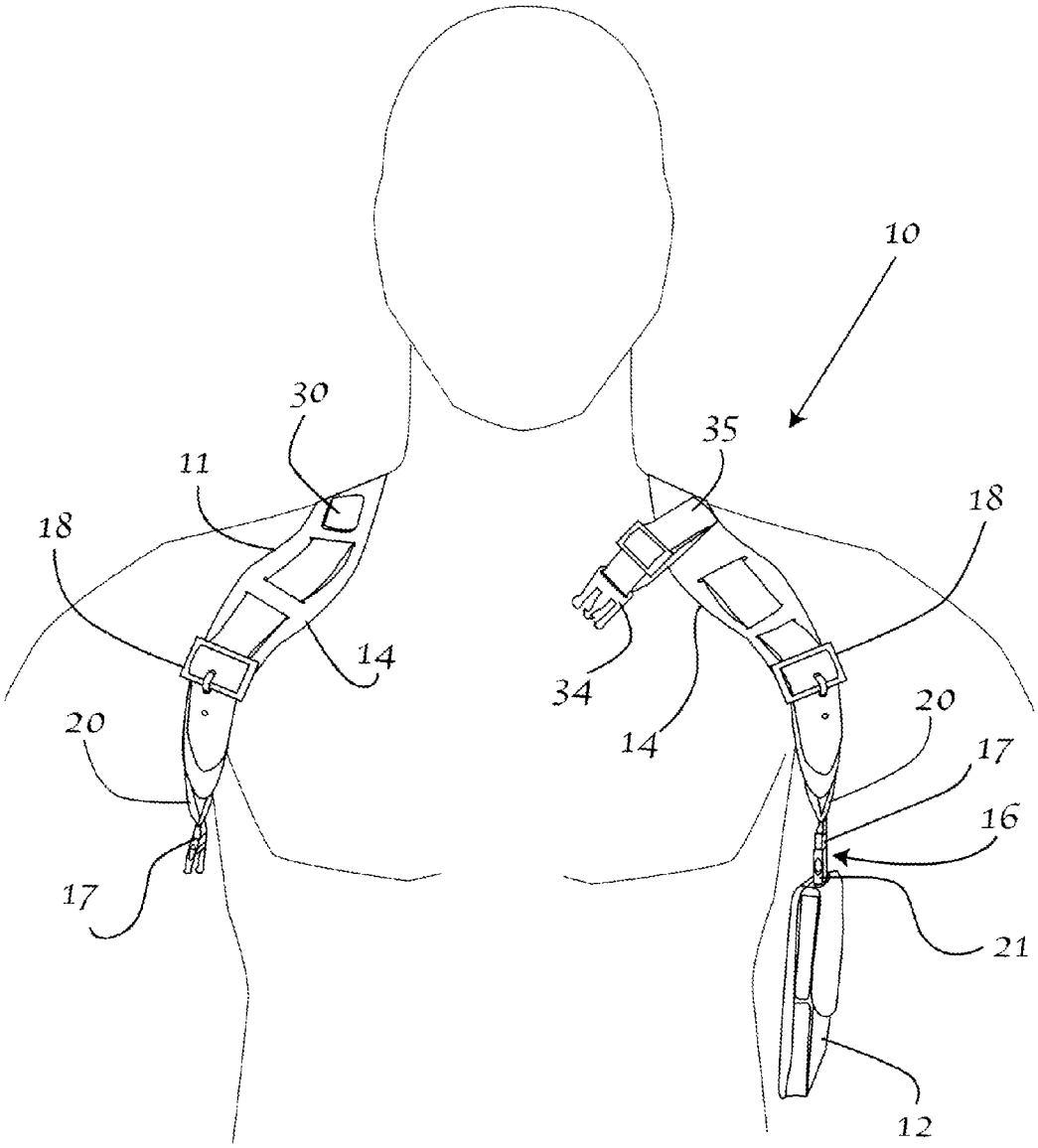
FIG. 2 is a detailed illustration of a front view of one embodiment of the shoulder strap carrying device without the front strap portion.

FIG. 2 is a detailed illustration of a front view of one embodiment of the shoulder strap carrying device without the front strap portion. As shown in FIG. 2, the shoulder strap carrying device 10 preferably includes a strap 11, a container 12, adjustment devices 18, front shoulder attachment portion 30, front shoulder fastener 34, and front should strap 35. The strap includes shoulder loop portions 14, a back connection portion 15 (the back connection portion 15 is shown on FIG. 3), and fastener portions 16. Fastener portion 16 is preferably comprised of strap fasteners 17 and container fastener 21. When strap fastener 17 is connected with container fastener 21, fastener portion 16 is formed.

The adjustment device 18 fits and secures the shoulder strap carrying device 10 around the shoulders of the wearer. The adjustment device 18 is not typically used to take the shoulder strap carrying device 10 on and off. Instead, the adjustment device 18 is preferably used to allow the user to adjust the size of loop portions 14 and allow a comfortable fit on the wearer.

Preferably, the shoulder strap carrying device 10 includes shoulder attachment portion 30, which can be used to secure additional straps, pouches, and/or fasteners to the device 10. Shoulder attachment portion 30 is preferably a hook and loop patch, but it can include any type of attachment device, including, but not limited to clips, sleeves, hooks, or other types of holders and connectors. When shoulder attachment portion 30 is a hook and loop patch, independent hook and loop pouches, sleeves, and containers can be slapped into place on shoulder attachment portion 30 and then easily removed.

FIG. 2 shows that in addition to including a shoulder attachment portion 30, the shoulder strap carrying device 10, may also include front shoulder strap 35, which preferably includes a front shoulder fastener 34. The front shoulder strap 35 may be removeably or permanently attached to loop portion 14. Indeed, it is preferred that the front shoulder strap 35 has a hook and loop portion that attaches to a hook and loop patch, similar to shoulder attachment portion 30, which is already connected to the shoulder strap carrying device 10. In this manner the front shoulder strap 35 is easily removed or added. The front shoulder fastener 34 may be used to hold various objects or even containers 12. Although FIG. 2 shows only one container 12 suspended substantially beneath the underarm of a wearer, any number of containers 12 may be attached to shoulder strap carrying device 10 without deviating the from the scope of the invention.

Figure 3:
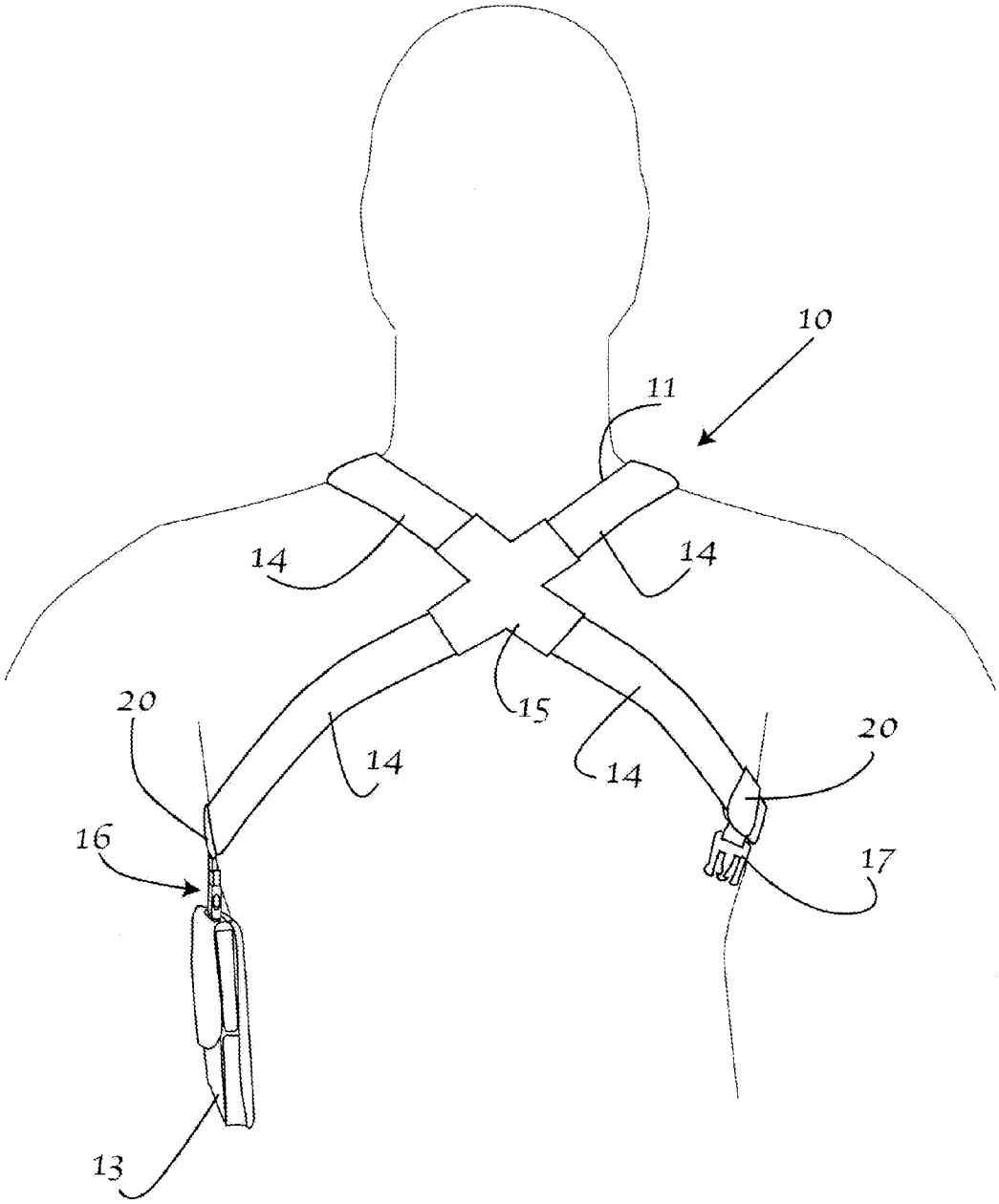
FIG. 3 is an illustration of a back view of one embodiment of the shoulder strap carrying device.

FIG. 3 is an illustration of a back view of one embodiment of the shoulder strap carrying device. As shown in FIG. 3, the shoulder strap carrying device 10 includes a strap 11 and a container 12. The strap 11 includes shoulder loop portions 14, a back connection portion 15, and fastener portions 16. FIG. 3 also shows the shoulder loop portions 14 joined by the back connection portion 15 to form an "X-shape" and shows the fastener portion 16 connecting the shoulder loop portions 14 to container 13. Container 13 is shown hanging substantially underneath the underarm of the wearer. Because FIG. 1 only shows one container being connected to the shoulder loop portions 14, strap fastener 17 is unused under the right underarm of the wearer.

The back connection portion 15 is preferably made out of leather, but any material may be used without deviating from the scope of the invention. Although FIG. 3 shows that the back connection portion is preferably a separate part that is connected through stitching, glue, or some other connection device, it should be understood that the shoulder strap carrying device 10 may be made from as few as a single integrated piece to any number of pieces, without deviating from the scope of the invention. FIG. 3 shows how the shoulder strap carrying device 10 fits comfortably on the user in a masculine manner.

Figure 4:
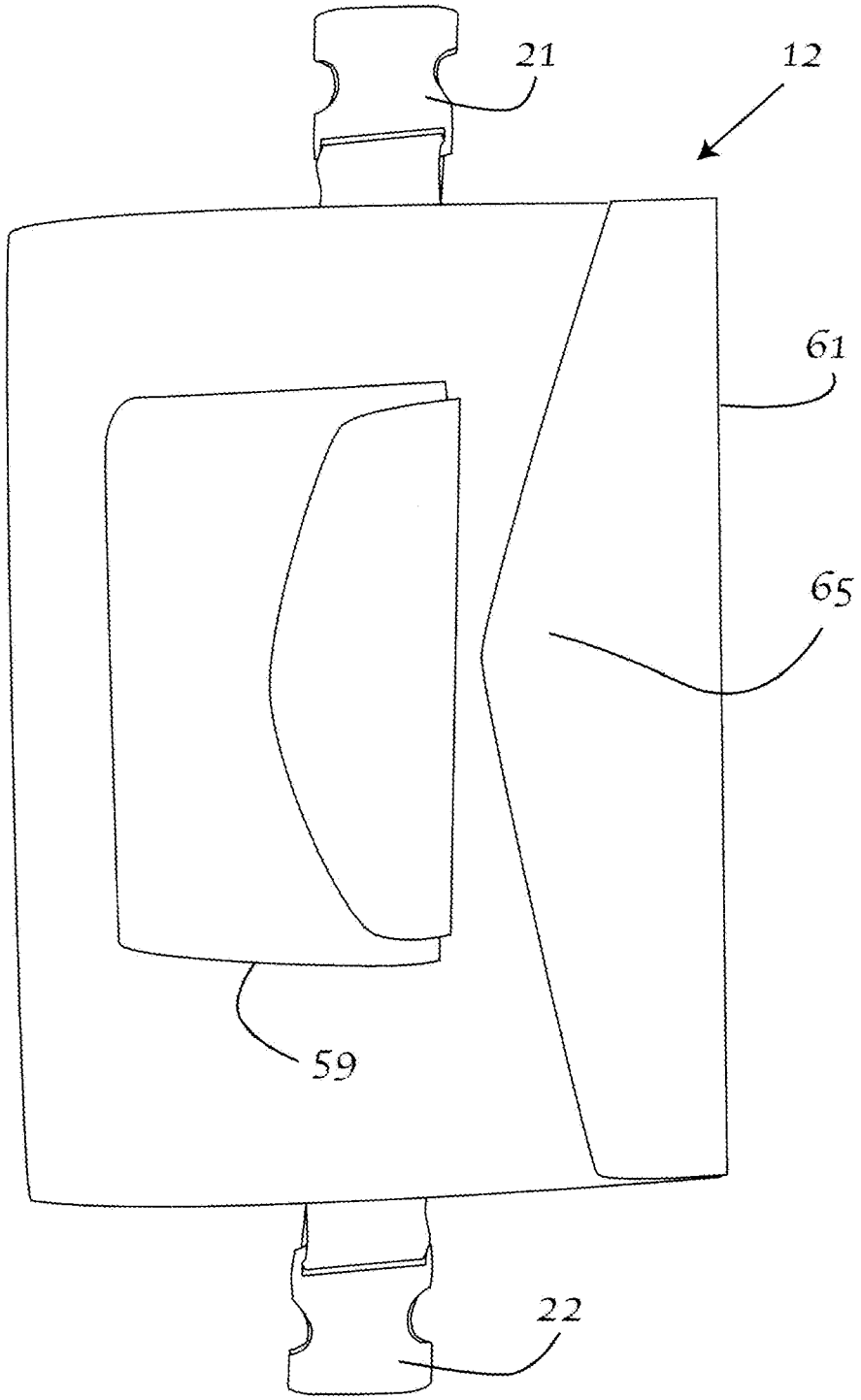
FIG. 4 is an illustration of a front view of one embodiment of a container.

FIG. 4 is an illustration of a front view of one embodiment of a container. As shown in FIG. 4, the container 12 includes container fastener 21 and two pouches 59 and 61. Pouch 61 has flap covering 65. The container fastener 21 is used to secure the container 12 to the strap fastener 17 of the strap 11 to suspend the container beneath the underarms of the wearer. FIG. 4 shows that container 12 may also include container fastener 22, which allows the container 12 to be connected to strap 11 underneath either underarm of the user and still have flap covering 65 face forward.

Although FIG. 4 only shows container 12 with two pouches, it should be understood that any number of pouches can be included. Pouch 61 is preferably designed to store such devices as a laptop or tablet computer. But it should be understood that any personal items may be stored, including, handheld videogame system, camera, pens, sundries, personal grooming articles, eyeglasses, and sunglasses. Pouch 19 is preferably a removable pouch that is slapped onto the side of pouch 61 through matching hook and loop connection patches disposed on pouch 19 and the outside of pouch 61.

The container is preferably made out of leather, but any material, natural or synthetic, may be used without deviating from the scope of the invention. The fasteners 21 and 22 are preferably quick release snap fasteners, as shown, but any type of fastener or connection device may be used. The pouch flap 65 is preferably secured to pouch 61 using a hook and loop fastener, but any type of fastening device may be used, including zippers, snaps, buttons, hooks, pins, glue, friction, and/or magnets.

Figure 5:
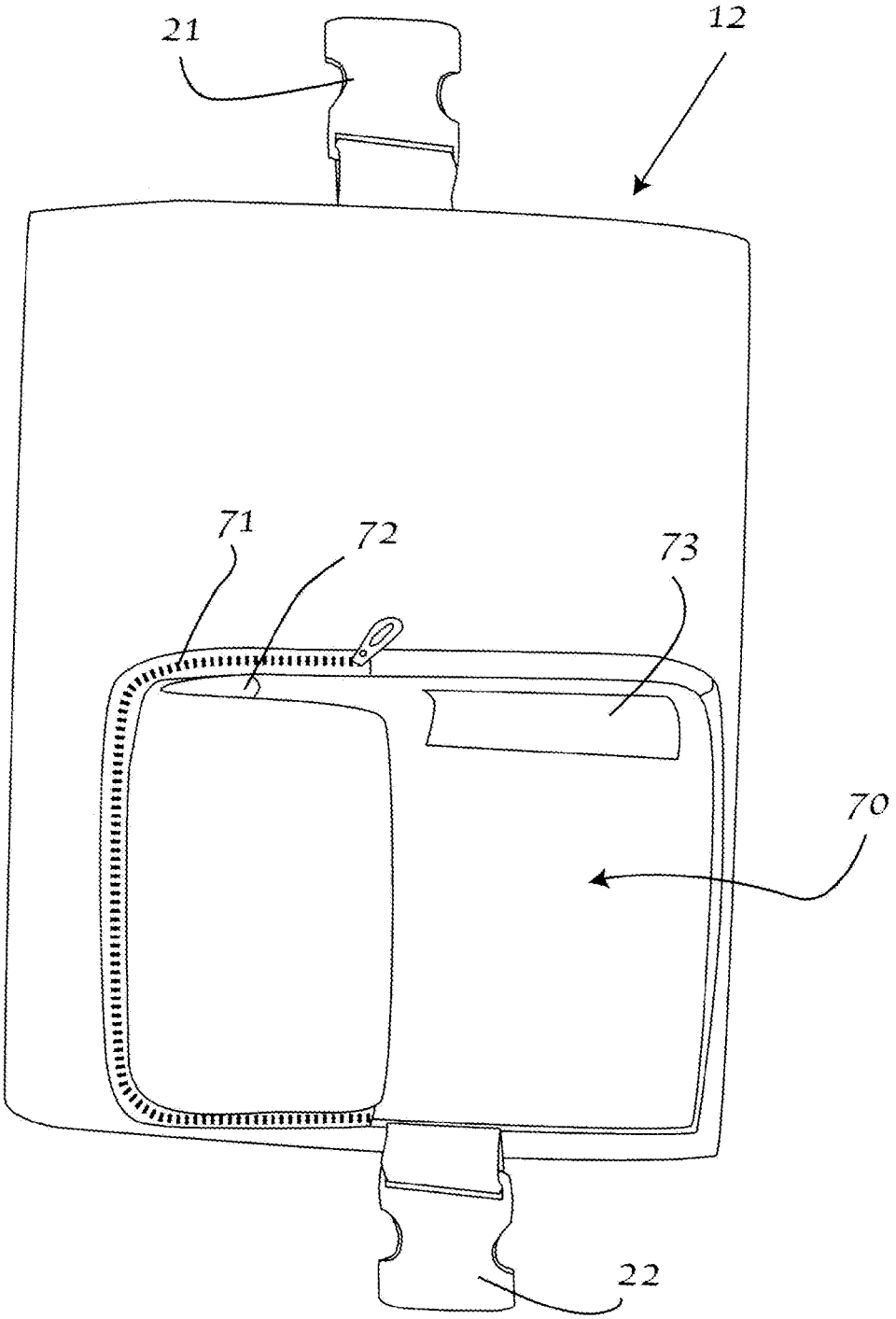
FIG. 5 is an illustration of a back view of one embodiment of the container shown in FIG. 4.

FIG. 5 is an illustration of a back view of one embodiment of the container shown in FIG. 4. As shown in FIG. 5, the container 12 includes fastener portions 21 and 22, and a pouch 70. Pouch 70 is shown as a small utility pouch with multiple pockets 71, 72, and 73. Pouch 70 may be permanently attached to container 12, or it may be removable and reattachable. If pouch 70 is removable, this allows the user flexibility in streamlining or making more complex the container 12 to suit the needs of the user.

Figure 6:
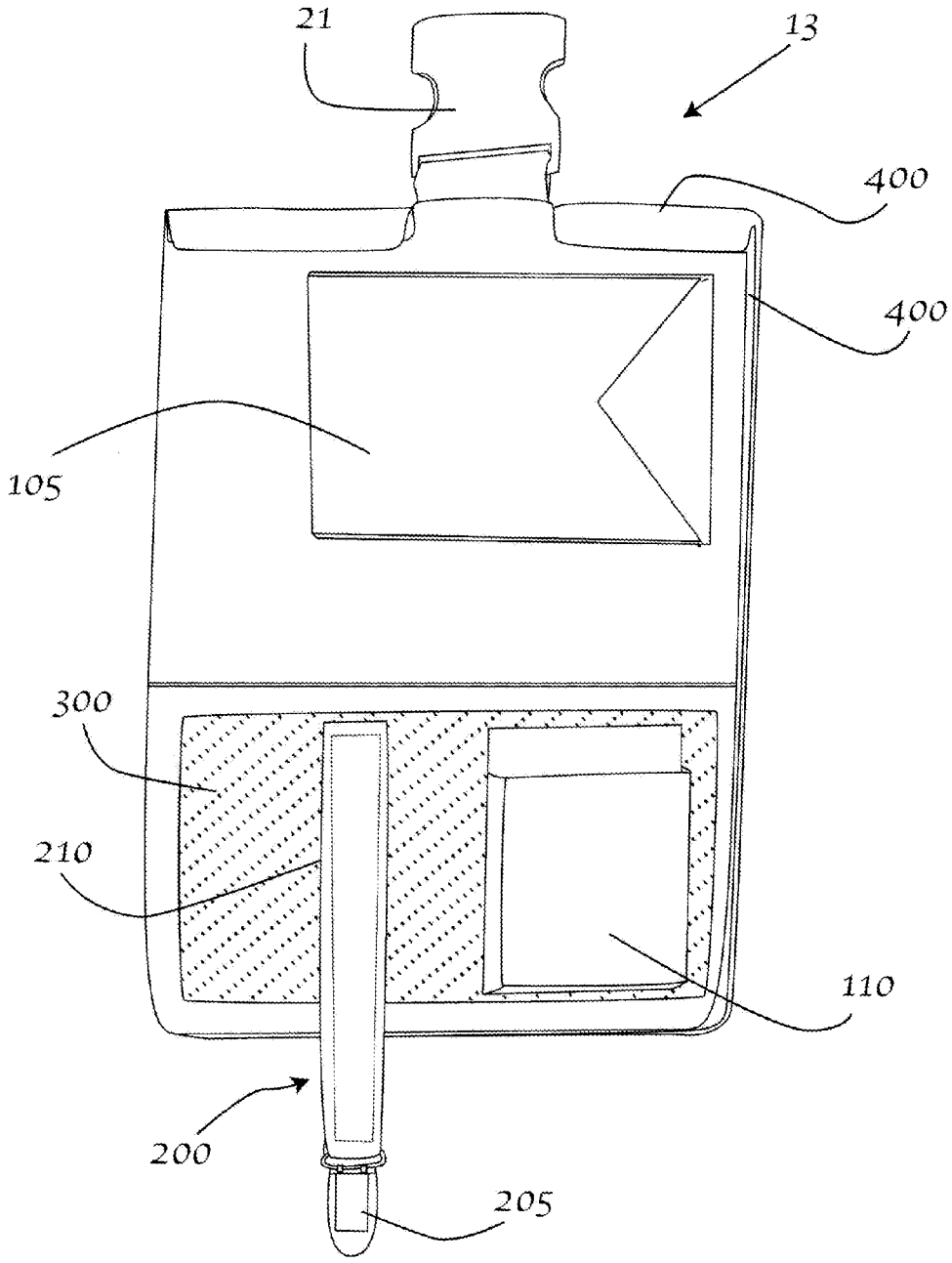
FIG. 6 is an illustration of a back view of one embodiment of another container showing a universal clip and a removable closure.

FIG. 6 is an illustration of a back view of one embodiment of another container showing a universal clip and a removable closure. As shown in FIG. 6, the container 13 includes fastener portion 21, pouches 105 and 110, a universal clip 200, hook and loop container patch 300, and removable closure 400. As shown in FIG. 6, the universal clip 200 preferably includes a container connection portion 210 and clip portion 205. The container connection portion 210 of the universal clip 200 preferably attaches to the container and the clip portion 205 is typically attached to the clothing of the wearer. This substantially prevents the container 13 from swinging free under the arm of the wearer. The connection portion 210 of the universal clip 200 may be permanently attached to container 13, but it is preferably removable and reattachable to and from the container 13. As shown in FIG. 6, the universal clip is preferably attached to hook and loop container patch 300 such that the clip portion 205 hangs outward from container 13 and is able to be connected or clipped to the users clothing. Although clip portion 205 is shown as a standard spring clamp or alligator clip, it should be understood that any clip or connection device may be used.

Removable closure 400 is shown as attached to container 13 on a front side of container 13, but covering a backside of container 13. Preferably, removable closure 400 is connected to container 13 via a hook and loop connection, but any connection device may be used. Further, the closure may be permanently attached, without deviating from the scope of the invention. Although containers 12 and 13 are preferably devices that include a built in pouches with defined openings and closings, it should be understood that the term containers may refer to any device that is connectable to strap 11 and is able to contain items of personal property in one or more pouches. As shown in FIG. 6, container 13 is essentially a platform to which removable pouches are attached. The pouches of the containers are preferably designed to hold personal items such as cash, money clips, keys, cigars, cigar cases, lighters, wallets, credit cards, flasks, cigarette packs, business cards, gum, condoms, personal grooming devices, lotion, bottles, cell phones, electronic devices, computers, media players, listening devices, and/or smart phones.

Figure 7:
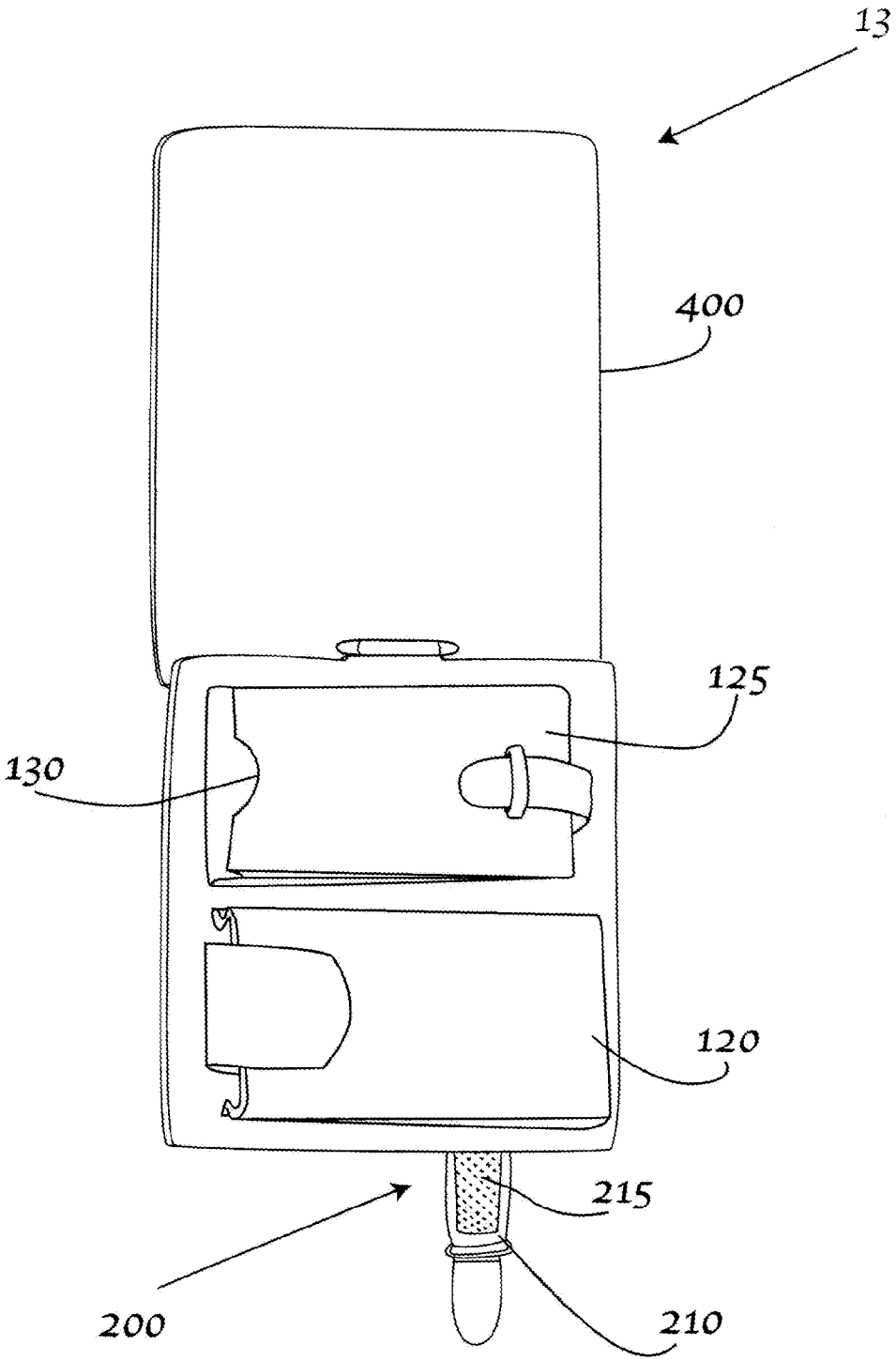
FIG. 7 is an illustration of a front view of one embodiment of the container shown in FIG. 6.

FIG. 7 is an illustration of a front view of one embodiment of the container shown in FIG. 6. As shown in FIG. 7, the container 13 includes universal clip 200, removable closure 400, and pouches 120, 125, and 130. FIG. 7 also shows the container connection portion 210 includes a hook and loop connection portion and clip portion 215, which allows universal clip 200 to be removeably connected to container 13. Pouches 120, 125, and 130 are preferably removeably connected to container 13 and, as shown, are designed to carry personal items of the wearer. For example, pouch 130 is for credit cards. Additionally, pouch 125 is preferably designed to be a detachable wallet and it swings outward to expose the contents of the wallet.

FIG. 6 and FIG. 7 show how some of the pouches are have a closed opening, such as with pouch 120, and wherein other pouches have an unencumbered opening, to allow personal items to be easily slid in and out of the top of the pouch, such as with pouch 110. Additionally, pouch 110 is a slot pocket that is removeably attached to hook and loop container patch 300.

Figure 8:
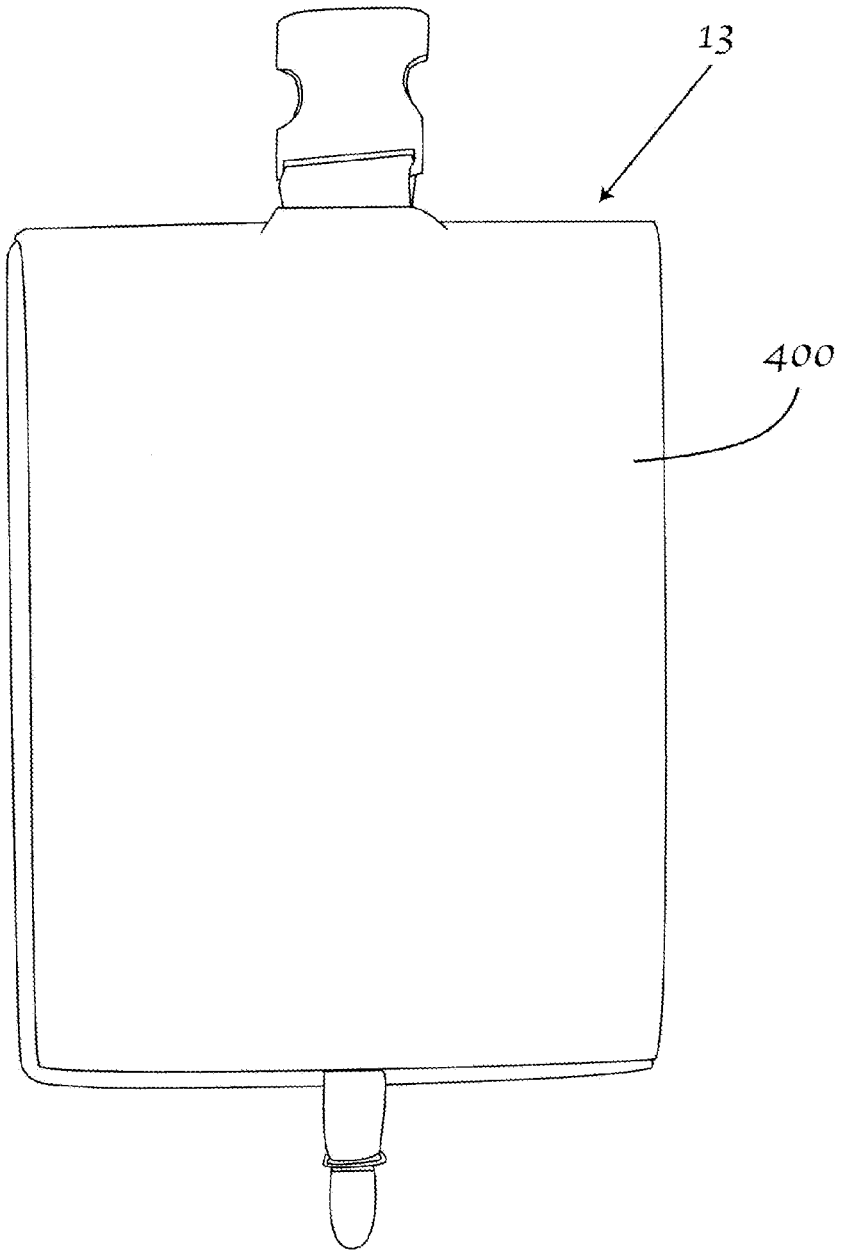
FIG. 8 is an illustration of a front view of one embodiment of the container shown in FIGS. 6 and 7 and shows the removable closure in a closed position.

FIG. 8 is an illustration of a front view of one embodiment of the container shown in FIGS. 6 and 7 and shows the removable closure in a closed position. FIG. 8 shows how the removable closure may be attached to container 13 and cover the pouches 120, 125, and 130.

Figure 9:
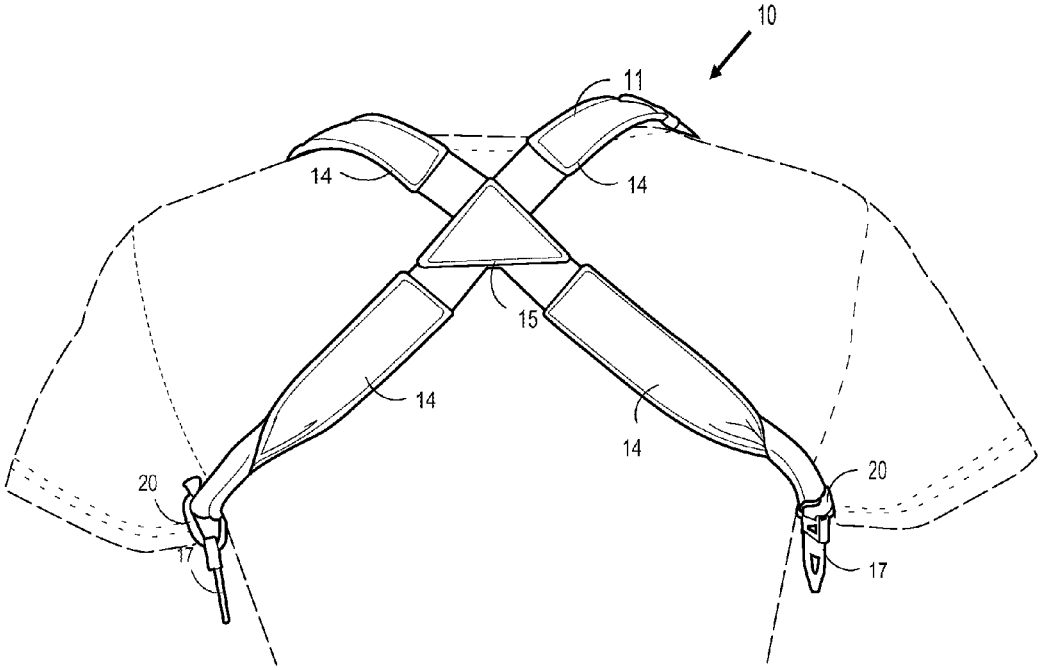
FIG. 9 is an illustration of a back view of another embodiment of the shoulder strap carrying device.

FIG. 9 is an illustration of a back view of another embodiment of the shoulder strap carrying device. As shown in FIG. 9, another embodiment of the shoulder strap device 10 may comprise: a strap 11, wherein the strap 11 may further comprise: shoulder loop portions 14, a back connection portion 15, strap fasteners 17. and holding members 20. FIG. 9 also shows the shoulder loop portions 14 may be joined by the back connection portion 15 to form an "X-shape" and shows the strap fasteners 17 slidably connected to the shoulder loop portions 14 via the holding members 20. Strap fasteners 17 are unused under both underarms of the wearer.

Figure 10:
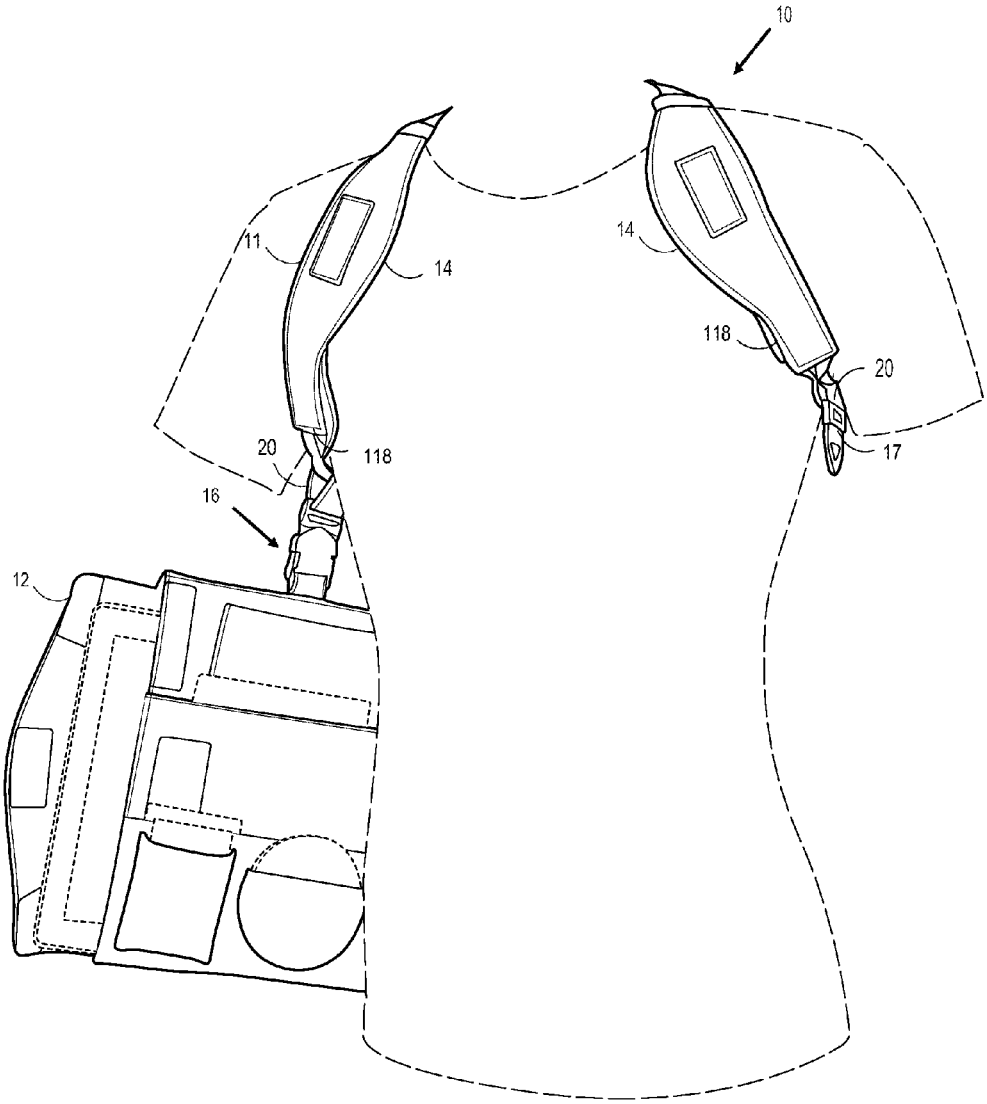
FIG. 10 is an illustration of a perspective view of another embodiment of the shoulder strap carrying device.

FIG. 10 is an illustration of a perspective view of another embodiment of the shoulder strap carrying device. As shown in FIG. 10, another embodiment of the shoulder strap carrying device 10 may comprise a strap 11 and container 12. The strap 11 may comprise shoulder loop portions 14, fastener portion 16, strap fastener 17 that is unused, adjustment devices 118, and holding member 20. FIG. 10 shows how the shoulder strap carrying device 10 may comprise of only one container 12, which may be removeably connected to the strap 11 at a single point of attachment. FIG. 10 also shows that the container 12 generally does not complete the loop of the strap 11 when attached to the strap 11 via the single point of attachment. Furthermore, FIG. 10 also shows that the adjustment devices 118 may use a hook and loop connection that wraps and fastens the shoulder loop portions 14 of the strap 11 around the upper arms of the wearer.

Figure 11:
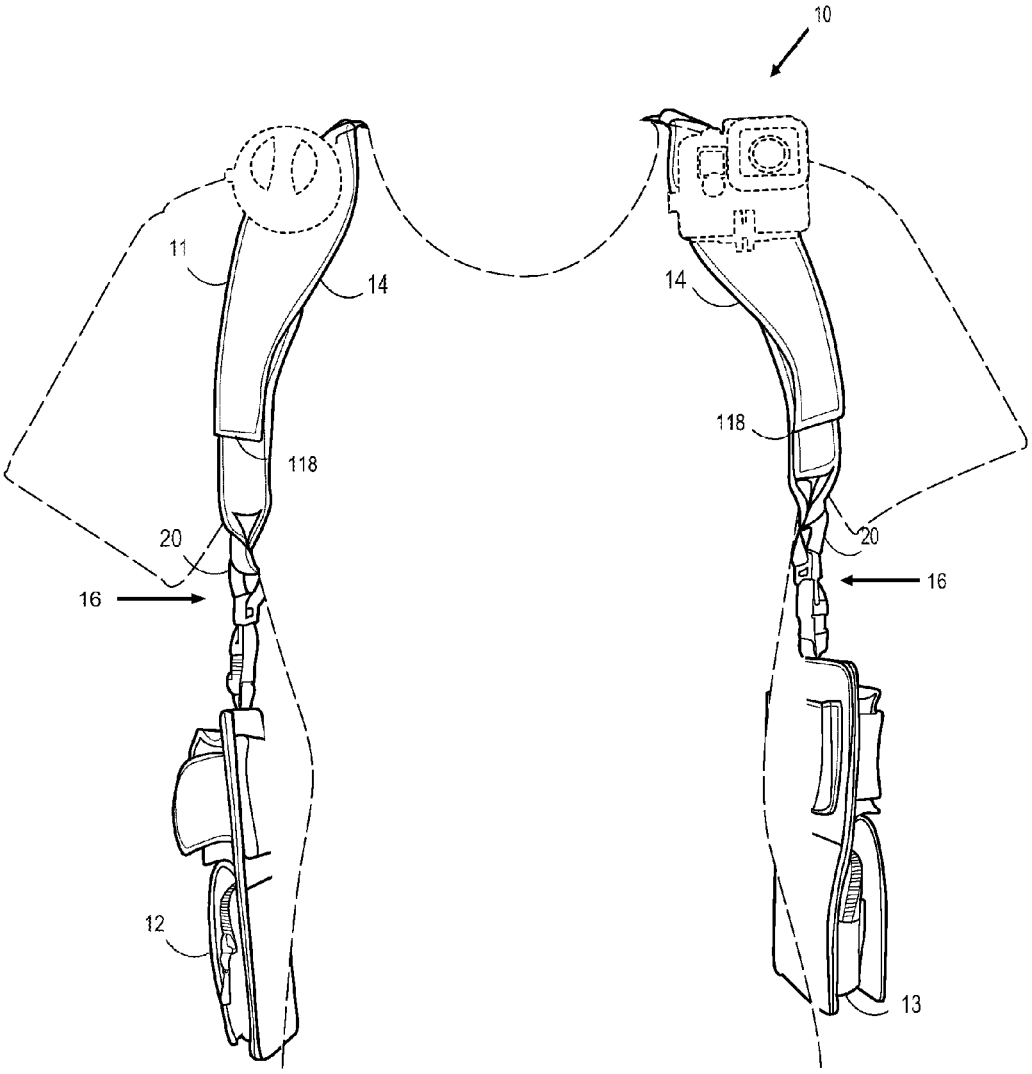
FIG. 11 is an illustration of a front view of another embodiment of the shoulder strap carrying device.

FIG. 11 is an illustration of a front view of another embodiment of the shoulder strap carrying device. As shown in FIG. 11, another embodiment of the shoulder strap carrying device 10 may comprise a strap 11 and containers 12, 13. The strap 11 may comprise shoulder loop portions 14, fastener portions 16, holding members 20, and adjustment devices 118. FIG. 11 shows how the shoulder strap carrying device 10 may comprise two containers 12, 13, which may be removeably connected to the strap 11 at a single point of attachment. FIG. 11 also shows that the containers 12, 13 generally do not complete the loop of the strap 11 when attached to the strap 11 via the single point of attachment. Furthermore, FIG. 11 shows how the adjustment device 118 may use a hook and loop connection that fastens and secures the shoulder loop portions 14 of the strap 11 around the upper arms and/or shoulders of the wearer.

Figure 12:
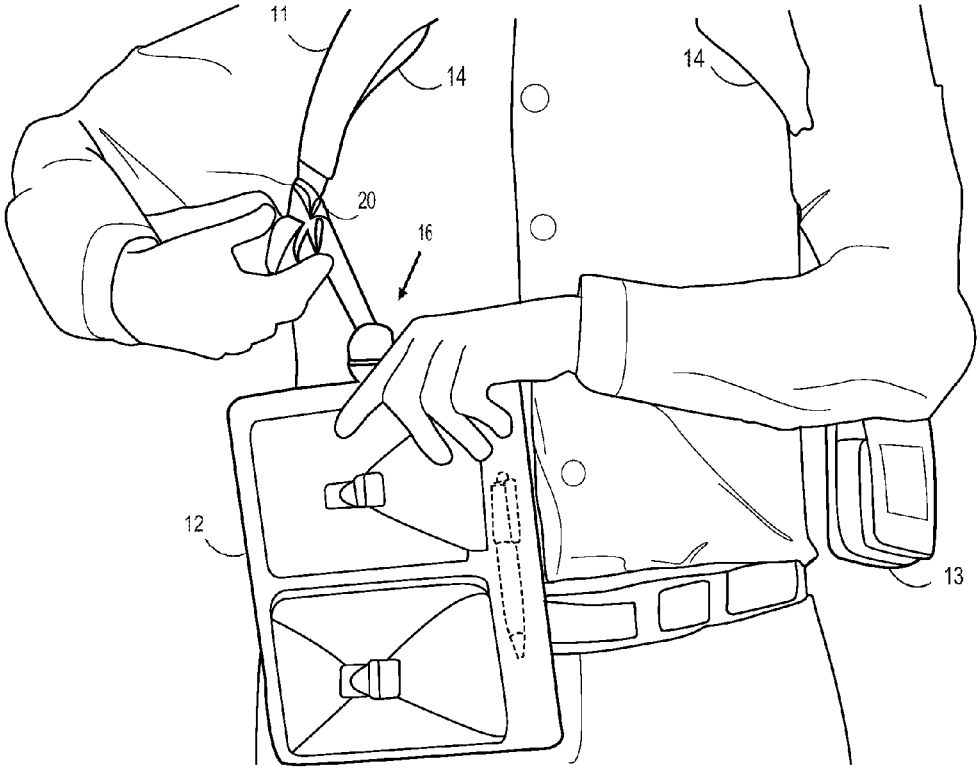
FIG. 12 is an illustration of a perspective view of another embodiment of the shoulder strap carrying device and shows a wearer removing a container of the shoulder strap carrying device.

FIG. 12 is an illustration of a perspective view of another embodiment of the shoulder strap carrying device and shows a wearer removing or attaching a container 12 from or to the shoulder strap carrying device 10. As shown in FIG. 12, another embodiment of the shoulder strap carrying device 10 may comprise a strap 11 and containers 12, 13. The strap 11 may comprise shoulder loop portions 14 and holding member 20. FIG. 12 also shows how a wearer may remove the container 12 at a single point of attachment. Specifically, FIG. 12 shows that the container 12 is easily connected or disconnected by sliding holding member 20 forward and then connecting or disconnecting container 12. Once the container 12 is connected or disconnected, holding member 20 is slid back into its comfortable resting place.

Unless otherwise stated, all measurements, values, ratings, positions, magnitudes, sizes, locations, and other specifications which are set forth in this specification, including in the claims which follow, are approximate, not exact. They are intended to have a reasonable range which is consistent with the functions to which they relate and with what is customary in the art to which they pertain.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A shoulder strap carrying device comprising:

a strap;

a first holding member;

a second holding member; and one or more containers;

wherein said strap comprises: a first shoulder loop portion, a second shoulder loop portion, and a back connection portion;

wherein said first shoulder loop portion and said second shoulder loop portion are connected to said back connection portion;

wherein said first holding member comprises a first fastener portion;

wherein said second holding member comprises a second fastener portion;

wherein said first shoulder loop portion and said second shoulder loop portion are connected to each other via said back connection portion;

wherein said strap is configured to fit around two upper arms of a wearer and across two upper shoulders of said wearer without requiring a connection with said first holding member, said second holding member, and said one or more containers;

wherein said first holding member and said first fastener portion are connected to said first shoulder loop portion and are configured to rest naturally and substantially beneath a left underarm of said wearer when said strap is worn by said wearer;

wherein said second holding member and said second fastener portion are connected to said second shoulder loop portion and are configured to rest naturally and substantially beneath a right underarm of said wearer when said strap is worn by said wearer;

wherein said one or more containers are configured to be removeably connected to said first fastener portion or said second fastener portion, such that said one or more containers, when connected to said first fastener portion or said second fastener portion, do not complete a looping of said first shoulder loop portion and said second loop portion;

wherein said first shoulder loop portion and said second shoulder loop portion each respectively further comprise a first adjustment device and a second adjustment device, such that there are two adjustment devices;

wherein said two adjustment devices are on a front side of said first and second shoulder loop portions;

wherein said first holding member is slideably connected along said first shoulder loop portion, such that said first shoulder loop portion functions as a sliding track for said first holding member, and said first holding member and said one or more containers are slideable in an uninterrupted manner from said back connection portion of said strap to one of said two adjustment devices, such that said wearer may position said one or more containers to be substantially directly in front of said wearer for easy access to said one or more containers; and wherein said second holding member is slideably connected along said second shoulder loop portion, such that said second shoulder loop portion functions as a sliding track for said second holding member, and said second holding member and said one or more containers are slideable in an uninterrupted manner from said back connection portion of said strap to one of said two adjustment devices, such that said wearer may position said one or more containers to be substantially directly in front of said wearer for easy access to said one or more containers when both first and second shoulder loop portions are around two upper arms of said wearer.

2. The shoulder strap carrying device of claim 1, wherein said two adjustment devices allow said wearer to adjust a size of said first shoulder loop portion and said second shoulder loop portion.

3. The shoulder strap carrying device of claim 2, further comprising a front shoulder strap;

wherein said front shoulder strap is removeably connected to an upper portion of said shoulder loop portion via a hook and loop patch;

wherein said front shoulder strap comprises a front shoulder fastener; and wherein said front shoulder fastener is configured to removeably connect said one or more containers.

4. The shoulder strap carrying device of claim 3, wherein said one or more containers are configured to removeably connect to one or more fastener portions;

wherein said one or more fastener portions are selected from the group of fastener portions consisting of: said first fastener portion, said second fastener portion, and said front shoulder fastener; and wherein said one or more containers have one or more pouches.

5. The shoulder strap carrying device of claim 4, further comprising:

one or more universal clips;

wherein said one or more universal clips comprise a container connection portion and a clip portion;

wherein said container connection portion is attached to at least one of said one or more containers; and wherein said clip portion is configured to be secured to an article of clothing of said wearer such that said one or more containers attached to said container portion are substantially prevented from swinging.

6. The shoulder strap carrying device of claim 5, wherein said container connection portion of said universal clip is removable from at least one of said one or more containers.

7. The shoulder strap carrying device of claim 6, further comprising:

a front strap portion;

wherein said front strap portion comprises two front straps and a front fastener;

wherein each of said two front straps are connected to said first shoulder loop portion and said second shoulder loop portion; and wherein at least one of said one or more containers are removeably connected to said front fastener.

8. The shoulder strap carrying device of claim 7, wherein said two front straps are removeably connected to said first shoulder loop portion and said second shoulder loop portion.

9. The shoulder strap carrying device of claim 8, wherein said one or more containers attached to said front fastener further comprises a solar panel.

10. The shoulder strap carrying device of claim 8, further comprising:

one or more front shoulder attachment portions;

wherein said one or more front shoulder attachment portions are connected to a front of each of said two shoulder loop portions and are a hook and loop patch.

11. The shoulder strap carrying device of claim 10, wherein said one or more front shoulder attachment portions comprise a sleeve to releasably hold a listening device selected from the group of listening devices consisting of one or more ear buds and one or more speakers.

12. The shoulder strap carrying device of claim 10, wherein said one or more front shoulder attachment portions comprise a front shoulder fastener.

13. The shoulder strap carrying device of claim 5, wherein said one or more fasteners are quick release snap fasteners.

14. The shoulder strap carrying device of claim 5, wherein at least one of said one or more pouches have removable closures.

15. The shoulder strap carrying device of claim 13, wherein at least one of said one or more pouches have removable closures.

16. The shoulder strap carrying device of claim 5, wherein at least one of said one or more pouches is removeably connected to at least one of said containers.

17. The shoulder strap carrying device of claim 15, wherein at least one of said one or more pouches is removeably connected to at least one of said containers.

18. A shoulder strap carrying device comprising:

a strap;

a first holding member;

a second holding member;

one or more containers;

one or more universal clips;

a front strap portion; and one or more front shoulder attachment portions;

wherein said strap comprises: a first shoulder loop portion, a second shoulder loop portion, and a back connection portion;

wherein said first shoulder loop portion and said second shoulder loop portion are connected to said back connection portion;

wherein said first holding member comprises a first fastener portion;

wherein said second holding member comprises a second fastener portion;

wherein said first shoulder loop portion and said second shoulder loop portion are connected to each other via said back connection portion;

wherein said strap is configured to fit around two upper arms of a wearer and across two upper shoulders of said wearer without requiring a connection with said first holding member, said second holding member, and said one or more containers;

wherein said first fastener portion is a first quick release snap fastener and said second fastener portion is a second quick release snap fastener;

wherein said first holding member and said first fastener portion are connected to said first shoulder loop portion and are configured to rest naturally and substantially beneath a left underarm of said wearer when said strap is worn by said wearer;

wherein said second holding member and said second fastener portion are connected to said second shoulder loop portion and are configured to rest naturally and substantially beneath a right underarm of said wearer when said strap is worn by said wearer;

wherein said one or more containers are configured to be removeably connected to said first quick release snap fastener or said second quick release snap fastener, such that said one or more containers, when connected to said first quick release snap fastener or said second quick release snap fastener, do not complete a looping of said first shoulder loop portion and said second loop portion;

wherein said first shoulder loop portion and said second shoulder loop portion each respectively further comprises a first adjustment device and a second adjustment device, such that there are two adjustment devices;

wherein said two adjustment devices are on a front side of said first and second shoulder loop portions;

wherein said adjustment device is configured to allow said wearer to remove said strap;

wherein said adjustment device allows said wearer to adjust a size of said first shoulder loop portion and said second shoulder loop portion;

wherein said first holding member is slideably connected along said first shoulder loop portion, such that said first shoulder loop portion functions as a sliding track for said first holding member, and said first holding member and said one or more containers are slideable in an uninterrupted manner from said back connection portion of said strap to one of said two adjustment devices, such that said wearer may position said one or more containers to be substantially directly in front of said wearer for easy access to said one or more containers; and wherein said second holding member is slideably connected along said second shoulder loop portion, such that said second shoulder loop portion functions as a sliding track for said second holding member, and said second holding member and said one or more containers are slideable in an uninterrupted manner from said back connection portion of said strap to one of said two adjustment devices, such that said wearer may position said one or more containers to be substantially directly in front of said wearer for easy access to said one or more containers when both first and second shoulder loop portions are around two upper arms of said wearer;

wherein said one or more containers have one or more pouches;

wherein said one or more universal clips comprise a container connection portion and a clip portion;

wherein said container connection portion of said one or more universal clips is removeably attached to at least one of said containers;

wherein said clip portion secured to an article of clothing of the wearer such that said one or more universal clips are substantially prevented from swinging;

wherein said front strap portion comprises two front straps and a front fastener;

wherein each of said two front straps are connected to each of said two shoulder loop portions;

wherein at least one of said one or more containers are removeably connected to said front fastener;

wherein said two front straps are removeably connected to said front loop portions;

wherein said one or more front shoulder attachment portions are connected to a front of each of said two shoulder loop portions and are a hook and loop patch;

wherein said one or more front shoulder attachment portions are selected from the group of front shoulder attachment portions consisting of: a sleeve to releasably hold a listening device; a front shoulder fastener; and a strap hook and loop connection patch;

wherein at least one of said one or more pouches have removable closures; and wherein at least one of said one or more pouches is removeably connected to at least one of said containers.

19. The shoulder strap carrying device of claim 18, further comprising:

a solar panel;

wherein said solar panel is removeably connected to said front fastener.

* * * * *